US010366661B2

(12) United States Patent
Ono

(10) Patent No.: US 10,366,661 B2
(45) Date of Patent: Jul. 30, 2019

(54) DISPLAY APPARATUS AND ITS CONTROL METHOD

(71) Applicant: CANON KABUSHIKI KAISHA, Tokyo (JP)

(72) Inventor: Masao Ono, Shimotsuke (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/723,708

(22) Filed: Oct. 3, 2017

(65) Prior Publication Data

US 2018/0102098 A1 Apr. 12, 2018

(30) Foreign Application Priority Data

Oct. 6, 2016 (JP) ..... 2016-198256

(51) Int. Cl.

| | |
|---|---|
| ***G09G 3/34*** | (2006.01) |
| ***G09G 3/20*** | (2006.01) |
| ***G09G 3/36*** | (2006.01) |
| ***G09G 3/00*** | (2006.01) |

(52) U.S. Cl.

CPC ..... *G09G 3/3413* (2013.01); *G09G 3/002* (2013.01); *G09G 3/2022* (2013.01); *G09G 3/2029* (2013.01); *G09G 3/36* (2013.01); *G09G 3/3607* (2013.01); *G09G 2310/06* (2013.01); *G09G 2310/08* (2013.01); *G09G 2320/0242* (2013.01); *G09G 2320/0266* (2013.01); *G09G 2320/064* (2013.01)

(58) Field of Classification Search

None

See application file for complete search history.

(56) References Cited

U.S. PATENT DOCUMENTS

| | | | | |
|---|---|---|---|---|
| 8,102,407 | B2 * | 1/2012 | Gally | G02B 26/001 345/698 |
| 2008/0094550 | A1 * | 4/2008 | Tawaraya | G02B 5/201 349/106 |
| 2009/0147154 | A1 | 6/2009 | Arai et al. | |

FOREIGN PATENT DOCUMENTS

| | | | |
|---|---|---|---|
| JP | H08511635 | A | 12/1996 |
| JP | 2011118067 | A | 6/2011 |
| WO | 9527970 | A1 | 10/1995 |

OTHER PUBLICATIONS

Office Action issued in Japanese Application No. 2016-198256 dated Aug. 7, 2018. English translation provided.

Extended European Search Report issued in European Appln. No. 17001618.2 dated Jan. 26, 2018.

* cited by examiner

*Primary Examiner* — Duane N Taylor, Jr.

(74) *Attorney, Agent, or Firm* — Rossi, Kimms & McDowell LLP

(57) ABSTRACT

A display apparatus includes a plurality of light modulation elements configured to modulate light from a light source for each color, and a driver configured to drive the plurality of light modulation elements using drive signals in accordance with a digital drive method. The driver makes different from one another start timings of the drive signals corresponding to one frame period for the plurality of light modulation elements.

11 Claims, 9 Drawing Sheets

DISPLAY APPARATUS AND ITS CONTROL METHOD

BACKGROUND OF THE INVENTION

Field of the Invention

The present invention relates to a display apparatus of a digital drive method.

Description of the Related Art

Along with progresses in a small configuration and a high resolution of a light modulation element, a display apparatus configured to drive the light modulation element using a drive signal in accordance with a digital drive method has been proposed. Where a plurality of light modulation elements are driven by the digital drive method, color breaking may occur.

Japanese Patent Laid-Open No. ("JP") 2011-118067 discloses a configuration that can reduce the color break in an image display apparatus that drives a reflection type liquid crystal panel in a field sequential color method.

However, in order to reduce the color break generated in the digital drive method, the configuration of the image display apparatus in the field sequential color method disclosed in JP 2011-118067 is inapplicable to the display apparatus configured to drive the plurality of light modulation elements by the digital drive method.

SUMMARY OF THE INVENTION

The present invention provides a display apparatus and its control method which can reduce a color break caused by a digital drive method.

A display apparatus according to the present invention includes a plurality of light modulation elements configured to modulate light from a light source for each color, and a driver configured to drive the plurality of light modulation element using drive signals in accordance with a digital drive method. The driver makes different from one another start timings of the drive signals corresponding to one frame period for the plurality of light modulation elements.

Further features of the present invention will become apparent from the following description of exemplary embodiments with reference to the attached drawings.

DESCRIPTION OF THE EMBODIMENTS

Referring now to the accompanying drawings, a detailed description will be given of an embodiment of the present invention.

Figure 1:
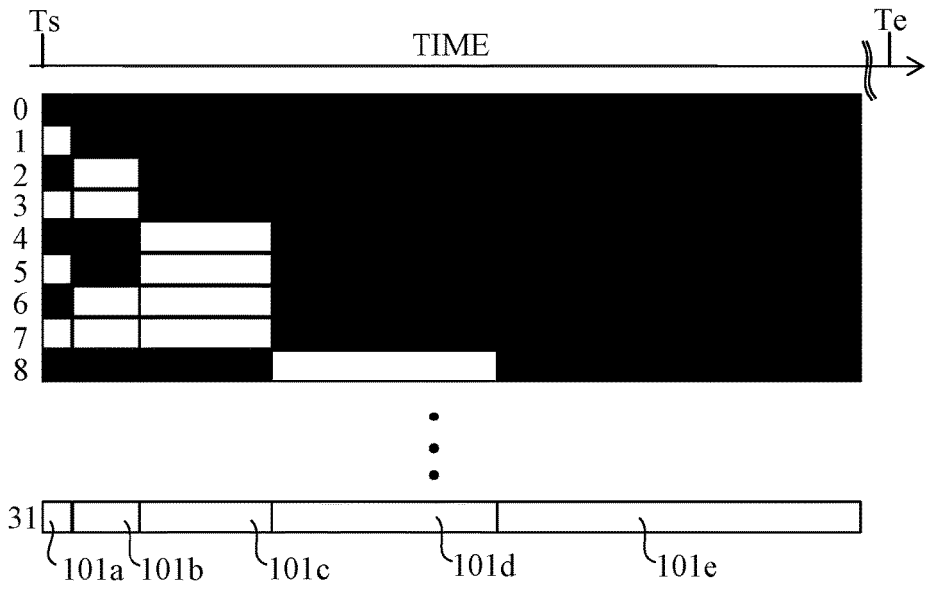
FIG. 1 is an explanatory view of a PWM drive method.
Figure 2:
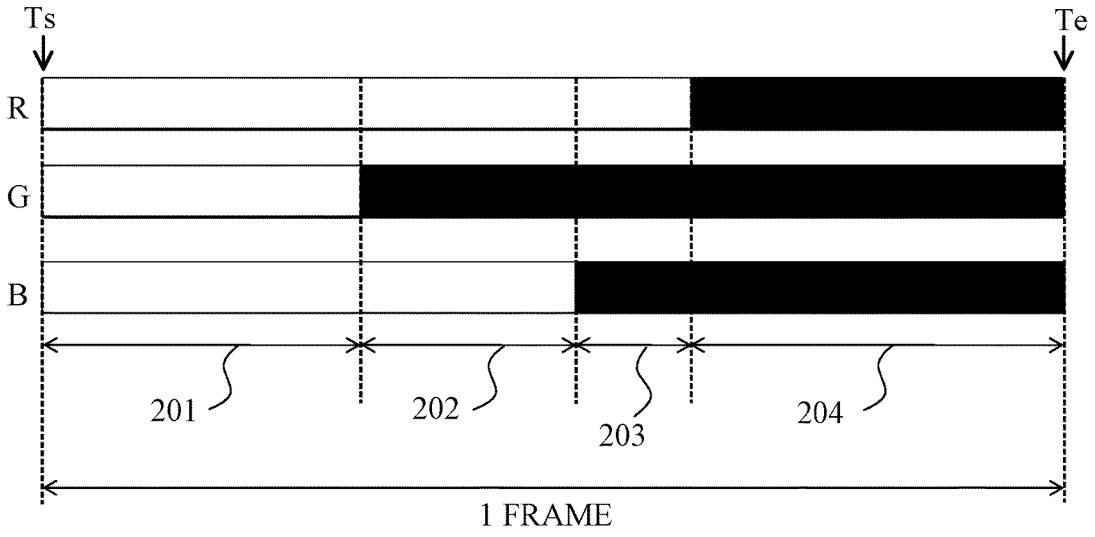
FIG. 2 is an explanatory view of how a color break is generated.

Referring now to FIGS. 1 and 2, a description will be given of driving of a liquid crystal display element (optical modulation element) in a digital drive method. FIG. 1 is an explanatory view of a PWM drive method as one illustrative digital drive method. FIG. 2 is an explanatory view of how a color break (color braking) is generated.

The PWM (pulse width modulation) drive method illustrated in FIG. 1 is used as one illustrative digital drive method of the liquid crystal display device. FIG. 1 illustrates part of one frame period in the PWM drive method, where an abscissa axis denotes time, an ordinate axis denotes a brightness (tone). In FIG. 1, Ts represents a start timing of drive signals for driving a liquid crystal display elements (of drive signals corresponding to one frame period), and Te represents an end timing of the one frame period.

As illustrated in FIG. 1, one frame period (which is a period for forming one frame image) is divided into a plurality of periods (subframes (SFs) 101*a*, 101*b*, 101*c*, 101*d*, 101*e*, . . . ) in the general PWM drive method. The tone is expressed by setting an ON period or an OFF period for (or by controlling turning on and off over) a plurality of subframes 101 contained in the one frame period according to a drive tone set based on the tone of an image signal (input image). In FIG. 1, a white subframe represents the ON period, a black subframe represents the OFF frame. For example, in expressing the tone of 0, all of the subframes 101*a* to 101*e* are set to the OFF period. In expressing the tone of 8, the subframes 101*a* to 101*c* and 101*e* are set to the OFF period and the subframe 101*d* is set to the ON period. In expressing the tone of 31, all of the subframes 101*a* to 101*e* are set to the ON period.

The color braking may occur in this liquid crystal display apparatus in the 3LCD method for driving a plurality of (three) liquid crystal display elements by a digital drive method. For example, in displaying the gray tone, as illustrated in FIG. 2, the ON and OFF periods in the PWM drive method may significantly different among the three liquid crystal display elements (RGB liquid crystal display elements or first, second, and third liquid crystal display elements). This is because the ON and OFF periods for the PWM drive control necessary to display the gray tone are different for each of the RGB liquid crystal display elements due to the influences of the RGB spectral intensities of the light source, and the light use efficiency of each wavelength band in the liquid crystal display elements.

In FIG. 2, a period 201 is the ON period in which all RGB liquid crystal display elements emit light. A period 202 is the ON period for the RB liquid crystal display elements, and the OFF period for the G liquid crystal display element. A period 203 is the ON period only for the R liquid crystal display element. In these periods 202 and 203, the projected light from the liquid crystal display apparatus is chromatically close to magenta and red, and when the user divides visual lines and views the projected image, he visually confirms the color break such as a color split and a color shift.

Figure 3:
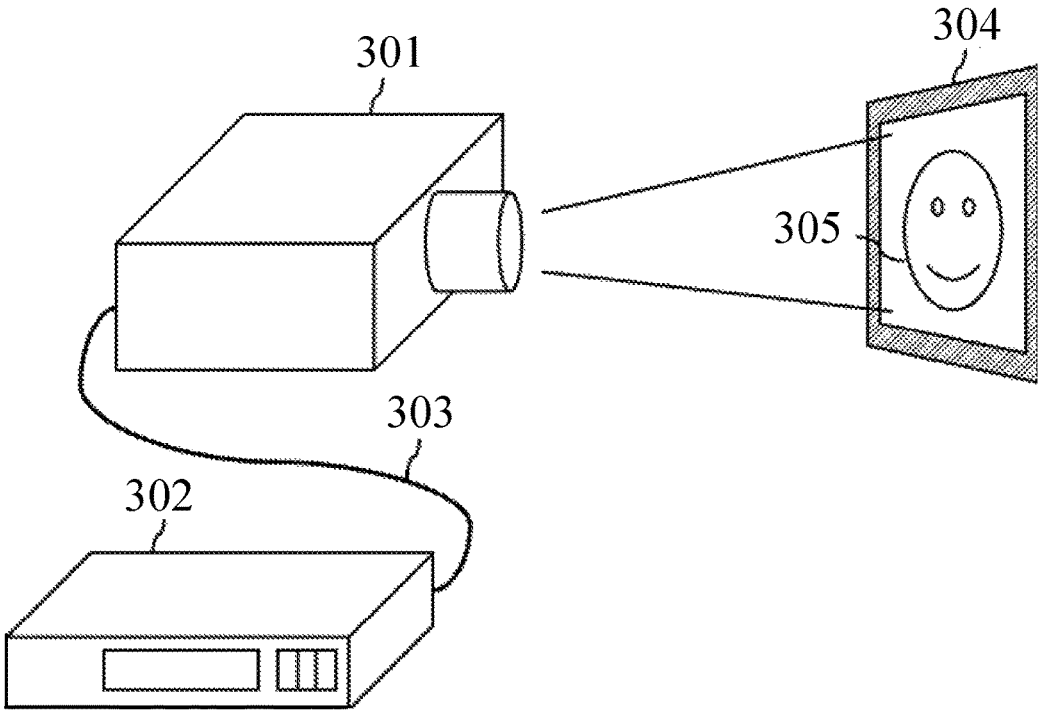
FIG. 3 is a schematic view of an image display system according to this embodiment.

Referring now to FIG. 3, a description will be given of an image display system according to this embodiment. FIG. 3 is a schematic view of the image display system. The image display system includes a liquid crystal projector 301 (display apparatus), and a video player 302. While this embodiment describes, as an illustrative display apparatus, the liquid crystal projector 301 using the liquid crystal display element as the optical modulation element, the color brake reducing method (image signal generating method) according to this embodiment is applicable to another display apparatus using an optical modulation element, such as a direct viewing type monitor.

An image signal (external image signal) output from the video player 302 is input into the liquid crystal projector 301 via a video cable 303. The liquid crystal projector 301 generates an image signal (output signal) suitable for display based on the input image signal (input signal), and projects an image 305 corresponding to the output signal onto a projected surface 304, such as a screen.

Figure 4:
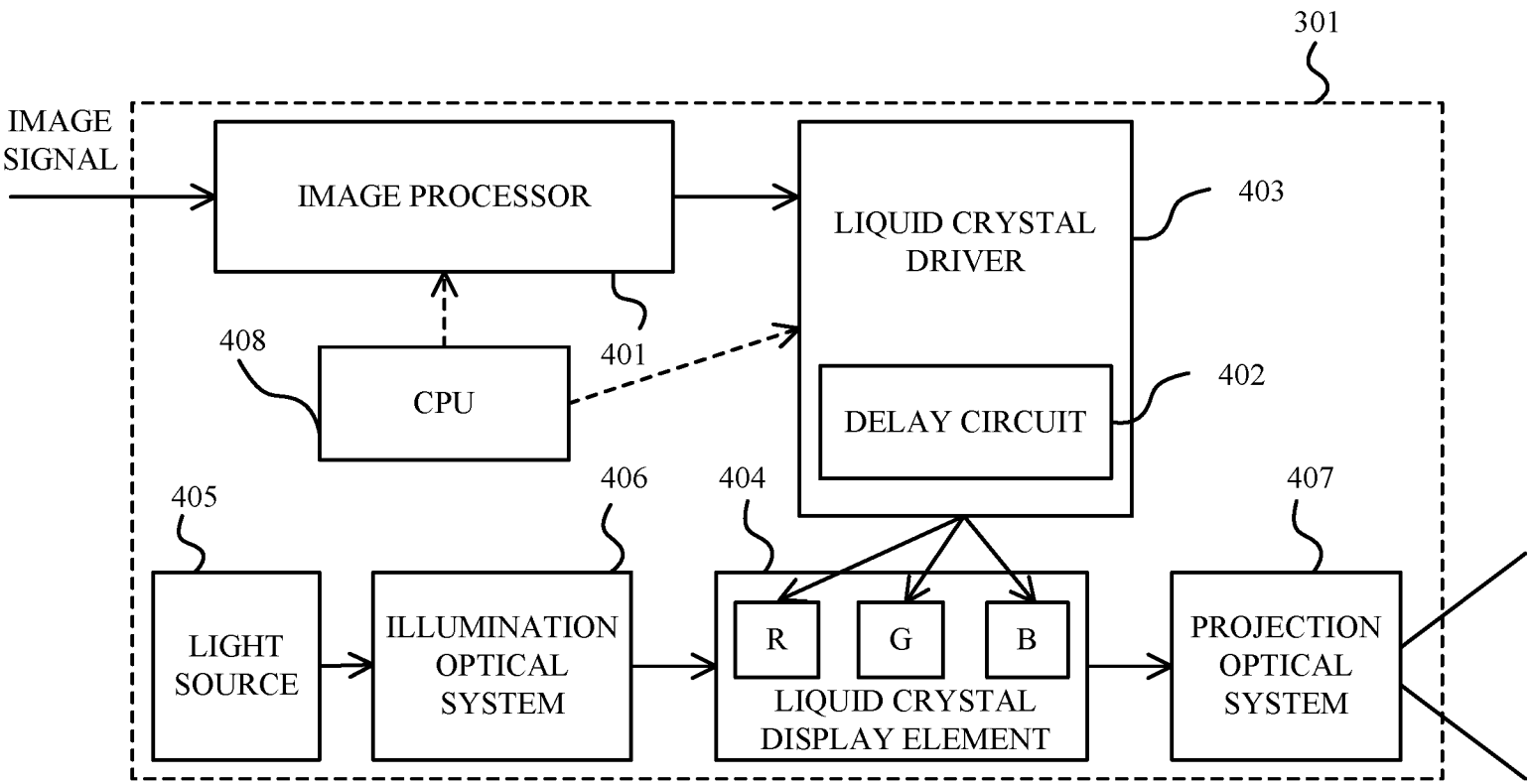
FIG. 4 is a block diagram of a liquid crystal display apparatus according to this embodiment.

Referring now to FIG. 4, a description will be given of a configuration of the liquid crystal projector 301. FIG. 4 is a block diagram of the liquid crystal projector 301. The image signal (input image) input into the liquid crystal projector 301 is input into an image processor 401. The image processor 401 performs a variety of processes, such as a brightness correction, a contrast correction, a gamma correction, and a color conversion, for the input image. The signal output from the image processor 401 is input into a liquid crystal driver 403.

The liquid crystal driver 403 drives a plurality of liquid crystal display elements 404, such as the RGB liquid crystal display elements, for example, liquid crystal panels, using the drive signals in accordance with a digital drive method (PWM drive method). The liquid crystal display element 404 modulates light from the light source 405 for each color. The liquid crystal display element 404 is provided for each of the RGB colors, and each liquid crystal display element 404 generates an image of each color (continuous frame images). The light from the light source 405 is separated into the three RGB color light fluxes by an illumination optical system 406, and input into and modulated by the three liquid crystal display elements 404. The three modulated color light fluxes are combined into one light flux and projected by a projection optical system 407.

The liquid crystal driver 403 includes a delay circuit 402. The delay circuit 402 delays the start timing Ts of the drive signal for driving at least one of the plurality of liquid crystal display elements 404. In other words, the delay circuit 402 provides a predetermined delay time to a start timing for at least one PWM drive in the RGB (output timing of the drive signal). Then, the delay circuit 402 generates the PWM pattern (drive signal) for the ON/OFF control according to each output tone, and outputs the PWM pattern to the corresponding liquid crystal display element 404. Thus, in this embodiment, the liquid crystal driver 403 shifts from one another the start timings Ts for the three liquid crystal display elements 404 of the drive signals corresponding to one frame period. A CPU 408 as a main controller controls the image processor 401 and the delay circuit 402, as well as controlling driving of the light source 405 and driving of the liquid crystal display elements 404 by the liquid crystal driver 403.

Figure 5:
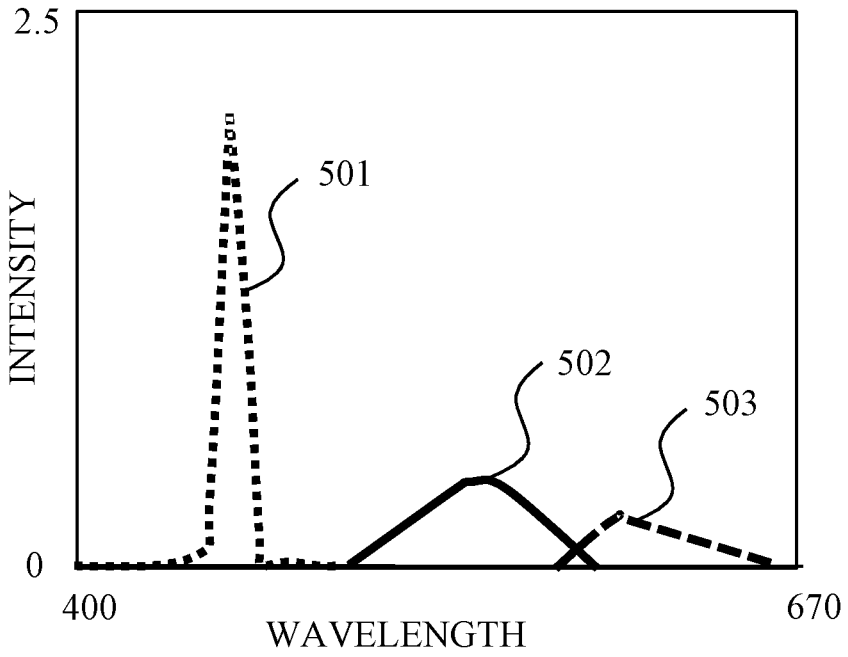
FIG. 5 illustrates a spectrum of projected light by a liquid crystal display apparatus.

Referring now to FIGS. 5 to 8, a description will be given of how the color break is generated where the liquid crystal display apparatus as a comparative example is used. FIG. 5 is a spectrum of the projected light from the liquid crystal display apparatus. FIGS. 6A to 6C are explanatory views of the drive signals corresponding to the spectrum illustrated in FIG. 5 (PWM drive signals).

Figure 6A:
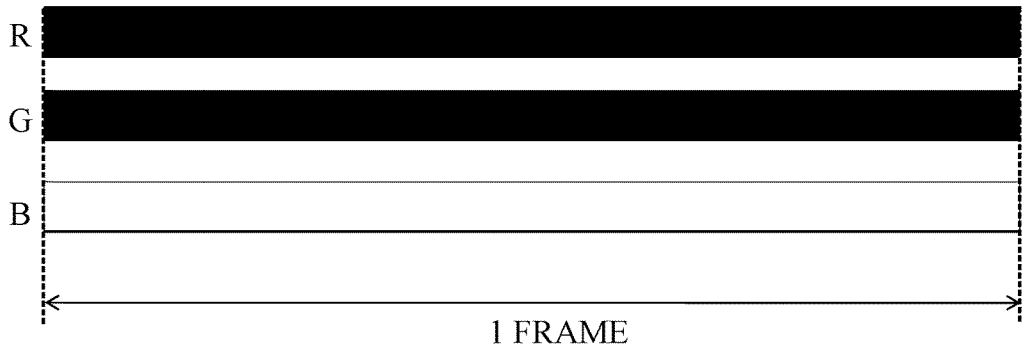
FIGS. 6A to 6C are explanatory views of a drive signal for a spectrum display illustrated in FIG. 5.
Figure 6B:
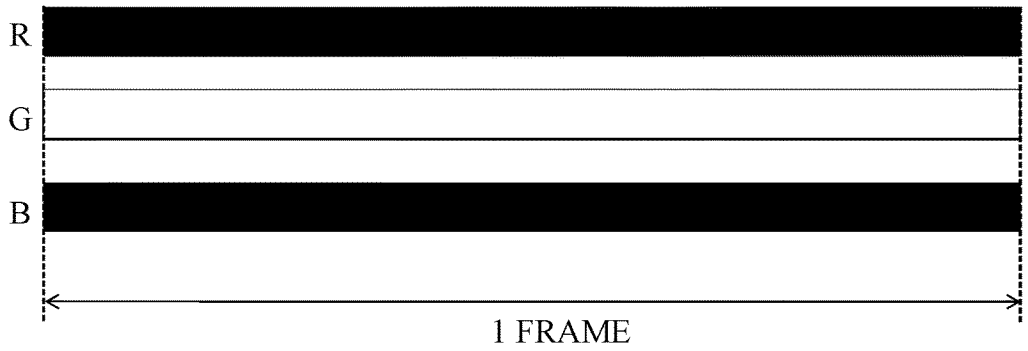
Figure 6C:
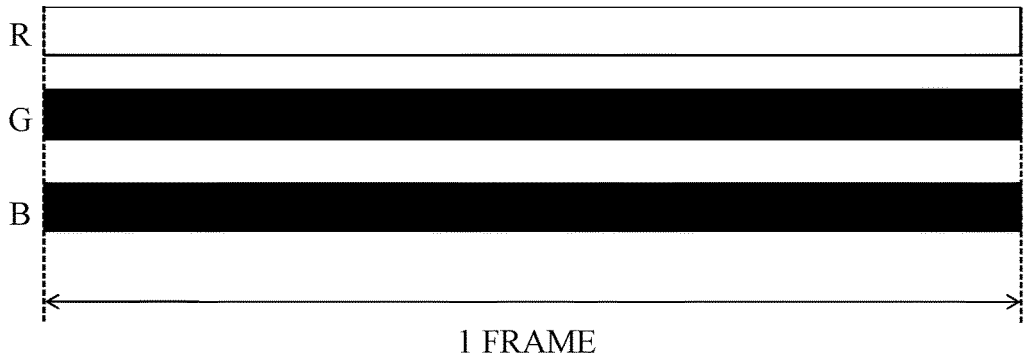

In FIG. 5, reference numeral 501 denotes a spectrum where the B liquid crystal display element is turned on over the one frame period as illustrated in FIG. 6A (or where the one frame period is wholly the ON period). Reference numeral 502 denotes a spectrum where the G liquid crystal display element is turned on over the one frame period as illustrated in FIG. 6B (or where the one frame period is wholly the ON period). Reference numeral 503 denotes a spectrum where the R liquid crystal display element is turned on over the one frame period as illustrated in FIG. 6C (or where the one frame period is wholly the ON period). In this embodiment, where the green (G) integral intensity is set to 1.00, the red (R) integral intensity is 0.40 and the blue (B) integral intensity is 0.70.

Figure 7:
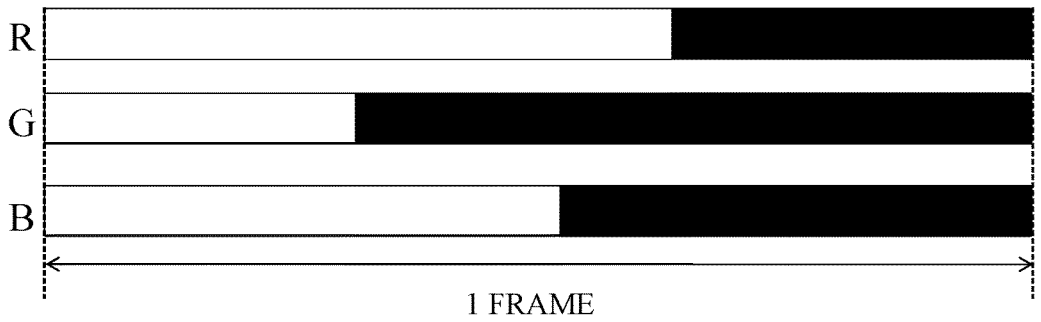
FIG. 7 is an explanatory view of a drive signal for white display.
Figure 8:
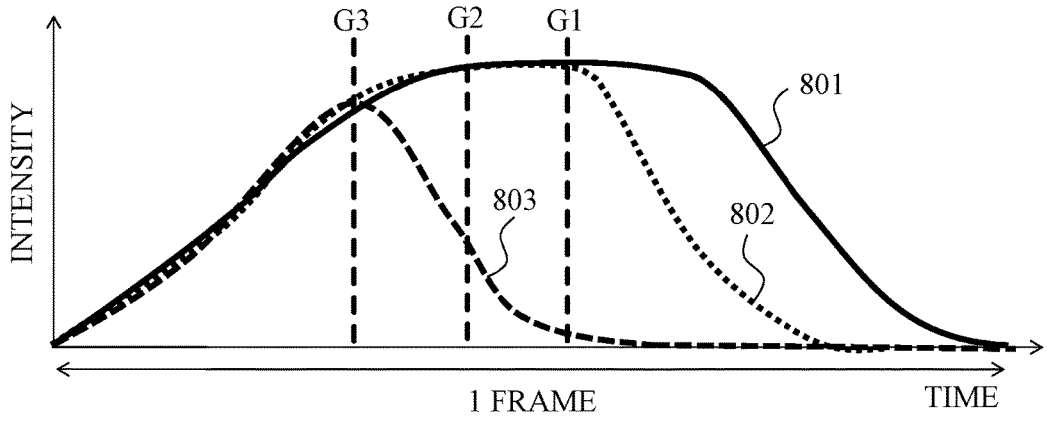
FIG. 8 illustrates optical response waveforms of liquid crystal display elements where drive signals illustrated in FIG. 7 are used.

FIG. 7 illustrates the ON and OFF periods in the PWM waveforms (drive signals) where the color is adjusted for the general white chromaticity (D65) in the liquid crystal display apparatus having such a spectrum characteristic. FIG. 8 illustrates optical response waveforms (waveforms of light emitted from the liquid crystal display elements) in the liquid crystal display apparatus where the liquid crystal display elements are driven with the PWM waveforms (drive signals) illustrated in FIG. 7. In FIG. 8, the abscissa axis denotes time (one frame period), and the ordinate axis denotes an intensity. Reference numeral 801 denotes an optical response waveform of red (R), reference numeral 802 denotes an optical response waveform of blue (B), and reference numeral 803 denotes an optical response waveform of green (G). Centroids or centers of gravity G1, G2, and G3 of the RGB light emitting waveforms (optical response waveforms) significantly shift from one another. Since the centroids of the optical response waveforms shift from one another, green is remarkably viewed at the peak in the optical response waveform 803. In the peaks of the optical response waveforms 802 and 801, blue and red are remarkably viewed. This is the reason why the color break is remarkably viewed.

Figure 9:
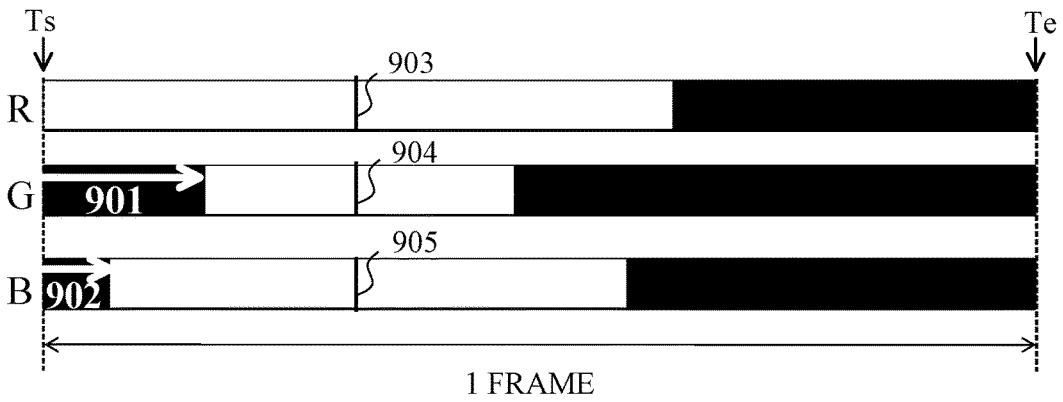
FIG. 9 is an explanatory view of a drive signal according to this embodiment.
Figure 10:
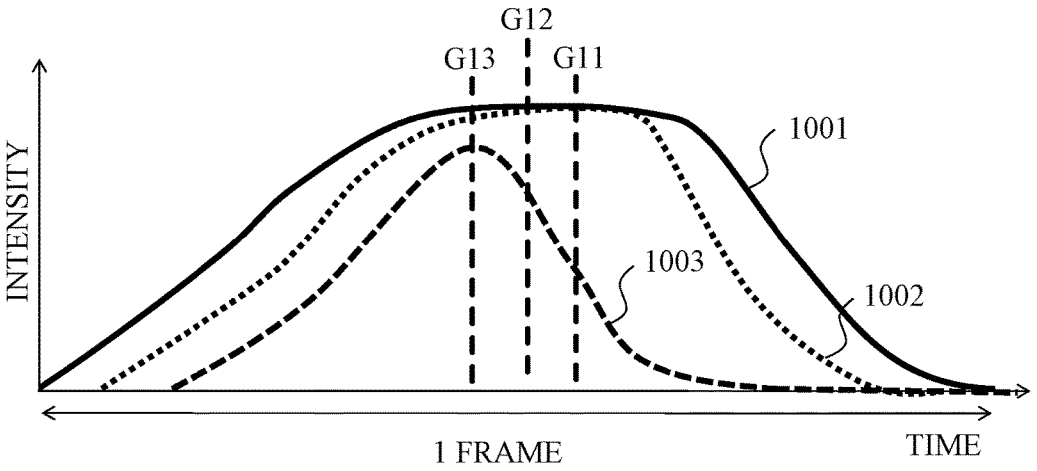
FIG. 10 illustrates optical response waveforms of the liquid crystal display elements where drive signals illustrated in FIG. 9 are used.

Referring now to FIGS. 9 to 12, a description will be given of the reduction of the color break where the liquid crystal display apparatus according to this embodiment is used. FIG. 9 is an explanatory view of the drive signals (ON and OFF periods) of the liquid crystal display elements according to this embodiment. FIG. 10 illustrates optical response waveforms of the liquid crystal display elements when the drive signals illustrated in FIG. 9 are used.

In FIG. 9, reference numeral 901 denotes a delay time (shift time) provided to a drive signal for the G liquid crystal display element by the delay circuit 402. Reference numeral 902 denotes a delay time (shift time) provided to a drive signal for the B liquid crystal display element by the delay circuit. As illustrated in FIG. 9, centers 903, 904, and 905 in the ON periods for the RGB accord with one another due to the delay times 901 and 902. In FIG. 10, reference numeral 1001 denotes an optical response waveform of red (R), reference numeral 1002 denotes an optical response waveform of blue (B), and reference numeral 1003 denotes an optical response waveform of green (G). In comparison with the centroids of G1, G2, and G3 illustrated in FIG. 8, the centroids G11, G12, and G13 of the light emission waveform (optical response waveform) are closer to one another than those in FIG. 8 and thus reduce the color break.

Figure 11:
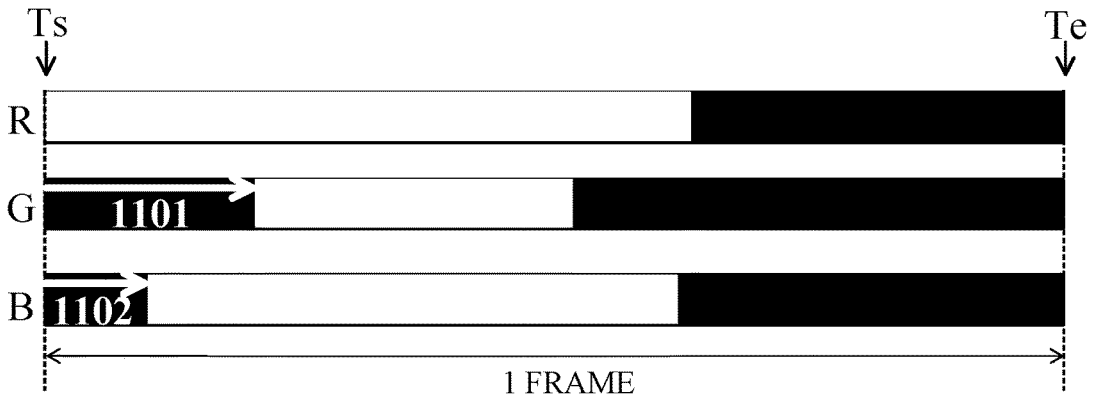
FIG. 11 is an explanatory view of a drive signal according to this embodiment.
Figure 12:
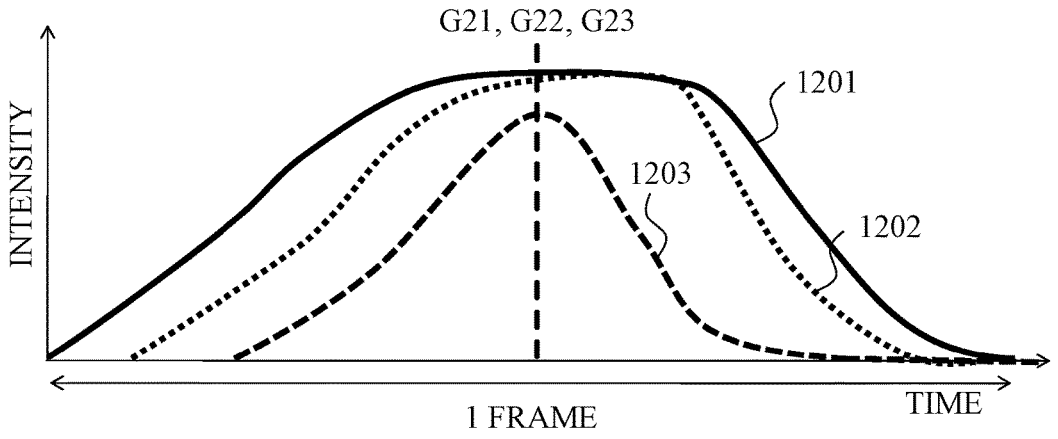
FIG. 12 illustrates optical response waveforms of the liquid crystal display element where drive signals illustrated in FIG. 11 are used.

The color break can be reduced by the delay times 901 and 902 as illustrated in FIG. 9. However, strictly speaking, the centroids G11, G12, and G13 of the RGB light emitting waveforms 1001, 1002, and 1003 do not accord with one another. This is because of the responsiveness of the liquid crystal display element. Since each of the RGB liquid crystal display elements is subject to the responsiveness, the center in the ON and OFF periods in the drive signal and the centroid of the light emitting waveform (optical response waveform) may not accord with each other depending on the intensity of the gray tone to be expressed. In this case, as illustrated in FIG. 11, the delay circuit 402 provides delay times 1101 and 1102. As a result, as illustrated in FIG. 12, centroids G21, G22, and G23 of the light emitting waveforms 1201, 12012, and 1203 can be accorded with one another (or made very close to one another). FIG. 11 is an explanatory view of the drive signals according to this embodiment. FIG. 12 illustrates optical response waveforms of the liquid crystal display elements where the drive signals in FIG. 11 are used.

In this embodiment, the liquid crystal driver 403 shifts the start timings of the drive signals so that a plurality of color light emission centroids of the plurality of liquid crystal display elements 404 (centroids of the optical response waveforms) approach to one another. The start timings may be shifted so that the plurality of color light emission centroids accord with one another. The optimal delay time is different according to the color and tone to be displayed by the liquid crystal display apparatus. Hence, the delay circuit 402 may control (vary) the delay time according to the color or the tone.

The plurality of liquid crystal display elements 404 in this embodiment includes a first liquid crystal display element configured to modulate light in the R band, a second liquid crystal display element configured to modulate light in the G band, and a third liquid crystal display element configured to modulate light in the B band. The liquid crystal driver 403 delays the start timing of the second liquid crystal display element relative to the start timing of the first liquid crystal display element. The liquid crystal driver 403 delays the start timing of the second liquid crystal display element relative to the start timing of the third liquid crystal display element. The liquid crystal driver 403 delays the start timing of the third liquid crystal display element relative to the start timing of the first liquid crystal display element. However, this embodiment is not limited to this example, and can arbitrarily vary a relationship of the start timing among the liquid crystal display elements so as to reduce the color break.

Figure 13A:
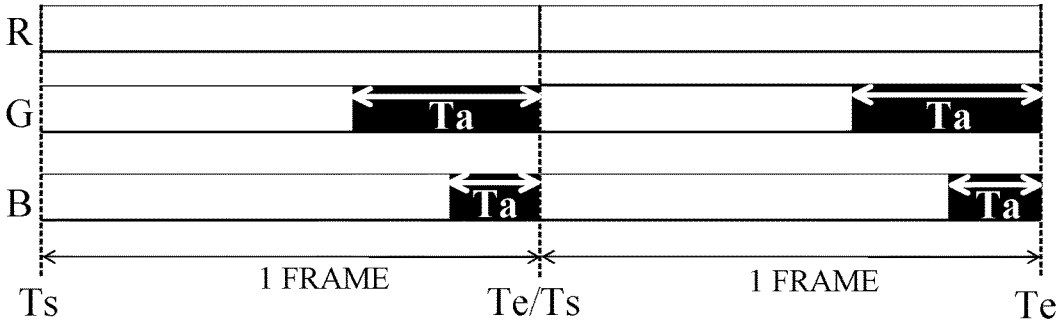
FIGS. 13A to 13C are explanatory view of a settable delay time in this embodiment.
Figure 13B:
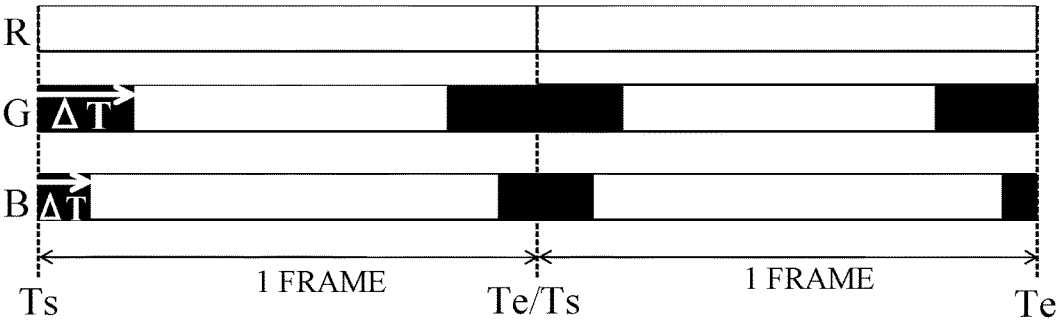
Figure 13C:
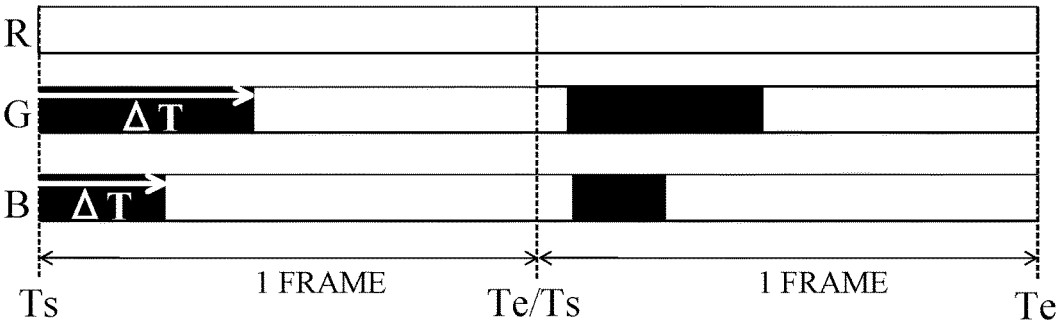

Now assume that $\Delta T$ is a shift time (delay time) of the start timing of the drive signal corresponding to the one frame period for at least one of the plurality of liquid crystal display elements, and Ta is a continuous OFF period in the one frame period up to the end timing in the one frame period. At this time, $\Delta T \leq Ta$ is to be satisfied. Referring now to FIGS. 13A to 13C, a description will be given of this relationship.

FIGS. 13A to 13C are explanatory views of the delay times settable according to this embodiment, and illustrate the ON and OFF periods in two frame periods when a maximum drive signal (PWM waveform) is input. FIGS. 13A to 13C illustrate $\Delta T=0$, $\Delta T \leq Ta$, and $\Delta T > Ta$, respectively. As illustrated in FIG. 13C, when $\Delta T > Ta$, the original light emitting period in one frame period may extend to the second frame. As a result, the image quality may be degraded when the liquid crystal display elements are driven. Hence, the shift time $\Delta T$ may be set so as to satisfy $\Delta T \leq Ta$.

When the responsiveness of the liquid crystal display element is considered as described above, the delay time may be longer than the shift time (delay time) necessary to accord the centers of the ON period of the drive signal with each other. In other words, the shift time $\Delta T$ provided by the delay circuit 402 may satisfy $\Delta T \geq Ta/2$. In conclusion, the shift time $\Delta T$ may satisfy the conditional expression of $Ta/2 \leq \Delta T \leq Ta$.

This embodiment can provide a display apparatus and its control method which can reduce a color break caused by the digital drive method.

While this embodiment drives the liquid crystal display element using the PWM drive method as a digital drive method, the present invention is not limited to this embodiment and may use the digital drive method other than the PWM drive method. In addition, while this embodiment shifts (delays) the start timing of the drive signal corresponding to the one period using the delay circuit for at least one liquid crystal display element, the present invention is not limited to this embodiment. For example, the start timing may be shifted by another method, such as a shift control by the CPU 408. Moreover, this embodiment uses the liquid crystal display element as a light modulation element, but may use a digitally drivable light modulation element, such as a DMD (digital mirror device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-198256, filed Oct. 6, 2016, which is hereby incorporated by reference herein in its entirety.

What is claimed is:

1. A display apparatus comprising:

a plurality of light modulation elements each configured to modulate light from a light source for a respective color; and a driver configured to drive the plurality of light modulation elements using drive signals in accordance with a digital drive method, wherein the driver is configured to make different, from one another, start timings of the drive signals corresponding to one frame period for the plurality of light modulation elements, wherein the driver is configured to generate the drive signals of the respective light modulation elements to control an ON period and an OFF period based on a tone of an input image in each of a plurality of subframes contained in the one frame period, and wherein in displaying a tone corresponding to a maximum tone of the input image, parts of the ON periods of the drive signals overlap with each other, and at least one of sums of the ON periods of the drive signals is shorter than the one frame period.

2. The display apparatus according to claim 1, wherein the driver includes a delay circuit configured to delay the start timings of the drive signals for driving at least one of the plurality of light modulation elements.

3. The display apparatus according to claim 2, wherein the delay circuit is configured to vary a delay time of the start timing according to a color or a tone.

4. The display apparatus according to claim 1, wherein the driver is configured to make different, from one another, the start timings of the drive signals so that light emission centroids for a plurality of colors output from the plurality of light modulation elements approach one another.

5. The display apparatus according to claim 1, wherein the digital drive method is a pulse width modulation (PWM) drive method.

6. The display apparatus according to claim 5, wherein the following conditional expression is satisfied:

$$Ta/2 \leq \Delta T \leq Ta,$$

where ΔT is a shift time of the start timing of the drive signal, and Ta is a continuous OFF period in the one frame period up to an end timing of the one frame period, each of ΔT and Ta corresponding to the one frame period for at least one of the plurality of light modulation elements.

7. The display apparatus according to claim 1, wherein the plurality of light modulation elements include a first light modulation element configured to modulate light in a red (R) band, a second light modulation element configured to modulate light in a green (G) band, and a third light modulation element configured to modulate light in a blue (B) band.

8. The display apparatus according to claim 7, wherein the driver is configured to delay the start timing for the second light modulation element relative to the start timing for the first light modulation element.

9. The display apparatus according to claim 7, wherein the driver is configured to delay the start timing for the second light modulation element relative to the start timing for the third light modulation element.

10. The display apparatus according to claim 7, wherein the driver is configured to delay the start timing for the third light modulation element relative to the start timing for the first light modulation element.

11. A control method for a display apparatus, the control method comprising the steps of:

modulating light from a light source for each color by driving a plurality of light modulation elements using drive signals in accordance with a digital drive method;

combining and projecting modulated light fluxes; and driving the plurality of light modulation elements to shift, from one another, the start timings of the drive signals corresponding to one frame period for the plurality of light modulation elements, wherein the driving step generates the drive signals of the respective light modulation elements to control an ON period and an OFF period based on a tone of an input image in each of a plurality of subframes contained in the one frame period, and wherein in displaying a tone corresponding to a maximum tone of the input image, parts of the ON periods of the drive signals overlap with each other, and at least one of sums of the ON periods of the drive signals is shorter than the one frame period.

* * * * *